US010018083B2

(12) United States Patent
McGowan et al.

(10) Patent No.: US 10,018,083 B2
(45) Date of Patent: Jul. 10, 2018

(54) LUBRICATING FLUID SYSTEM FOR A VEHICLE WITH SELF COMPENSATION PLATE

(71) Applicant: GM GLOBAL TECHNOLOGY OPERATIONS LLC, Detroit, MI (US)

(72) Inventors: Sean M. McGowan, Northville, MI (US); Bryan K. Pryor, Waterford, MI (US); John Byron Davis, Hartland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 270 days.

(21) Appl. No.: 14/884,291

(22) Filed: Oct. 15, 2015

(65) Prior Publication Data

US 2017/0107872 A1 Apr. 20, 2017

(51) Int. Cl.

| | |
|---|---|
| ***F01M 1/02*** | (2006.01) |
| ***F04C 2/18*** | (2006.01) |
| ***F01M 1/12*** | (2006.01) |
| ***F04C 15/00*** | (2006.01) |

(52) U.S. Cl.

CPC ..... *F01M 1/02* (2013.01); *F01M 1/12* (2013.01); *F04C 2/18* (2013.01); *F04C 15/0026* (2013.01); *F01M 2001/0238* (2013.01); *F01M 2001/123* (2013.01); *F01M 2001/126* (2013.01)

(58) Field of Classification Search

CPC ..... F04C 15/0026

USPC ..... 123/196 R

See application file for complete search history.

(56) References Cited

U.S. PATENT DOCUMENTS

| | | | | |
|---|---|---|---|---|
| 2,745,356 A * | 5/1956 | Lauck | F04C 15/0026 | 418/132 |
| 2,982,221 A * | 5/1961 | Whitfield | F04C 2/084 | 418/200 |
| 3,664,777 A * | 5/1972 | Yasuo | F04C 15/0026 | 418/131 |
| 5,108,275 A * | 4/1992 | Sager | F04C 2/16 | 418/150 |
| 5,417,556 A * | 5/1995 | Waddleton | F04C 15/0026 | 418/132 |
| 2005/0180870 A1* | 8/2005 | Stanley | F04B 23/06 | 417/440 |

FOREIGN PATENT DOCUMENTS

| | | |
|---|---|---|
| CN | 2549210 Y | 5/2003 |
| CN | 1544814 A | 11/2004 |
| CN | 202284539 U | 6/2012 |

* cited by examiner

*Primary Examiner* — Kevin A Lathers
(74) *Attorney, Agent, or Firm* — Quinn IP Law

(57) ABSTRACT

A fluid pump includes a housing defining a cavity. An end plate is disposed within the cavity and divides the cavity into a gear section and an end section. A gear set is disposed within the gear section and comprises at least one gear rotatable about an axis. The end plate is movable longitudinally along the axis for compressing the gear set. A channel is in fluidic communication with the end section for supplying a fluid to the end section to force the plate toward the gear set.

17 Claims, 7 Drawing Sheets

LUBRICATING FLUID SYSTEM FOR A VEHICLE WITH SELF COMPENSATION PLATE

TECHNICAL FIELD

The disclosure generally relates to lubricating fluid pumps for propulsion systems of vehicles and more specifically to scavenge oil pumps.

BACKGROUND

Scavenge oil pumps typically include a plurality of gear sets disposed together in a housing. The gear sets may be separated by plates, with the entire assembly fitting tightly together. Although these gear sets and plates are manufactured at precise tolerances, in order to ensure the best fit, the dimensions of an end plate compressing the gear sets and plates is often variable based on the dimensions of the housing, the gear sets, and the plates. Furthermore, differing thermal expansion rates of the materials utilized in the pump may also cause dimensional variances. For example, when a housing is formed of aluminum and gear sets are formed of steel, the expansion rates of each will vary, thus causing dimensional variances. As such, the end plate and/or the gear sets may have to be manufactured in a variety of different widths and then selected based on the materials utilized and the final measurements of the other components.

Manufacturing an otherwise identical part in many different sizes and/or widths may lead to higher costs as well as lower reliability of the finished assembly. Therefore, there remains an opportunity to provide a scavenge oil pump that does not require different sized components while still maintaining a snug fit of the gear sets and separator plates.

SUMMARY

A fluid pump, according to one embodiment, includes a housing defining a cavity. An end plate is disposed within the cavity and divides the cavity into a gear section and an end section. A gear set is disposed within the gear section and comprises at least one gear rotatable about an axis. The end plate is movable longitudinally along the axis for compressing the gear set.

A lubricating fluid system for a vehicle, according to one embodiment, includes a first fluid pump. The first fluid pump includes a housing defining an inlet for receiving fluid, a cavity fluidly connected to the inlet, and an outlet fluidly connected to the cavity. A plate is disposed within the cavity and divides the cavity into a gear section and an end section. A gear set is disposed within the gear section and including at least one gear rotatable about an axis. The plate is movable longitudinally along the axis for compressing the gear set. The system also includes a reservoir fluidly connected to the outlet of the first fluid pump. The system further includes a second fluid pump having an inlet fluidly connected to the reservoir for receiving fluid from the reservoir.

A vehicle, according to one embodiment includes an internal combustion engine. The vehicle also includes a first fluid pump having a housing defining an inlet fluidly connected to the internal combustion engine for receiving a lubricating fluid, a cavity fluidly connected to the inlet, and an outlet fluidly connected to the cavity. The first fluid pump also includes a plate disposed within the cavity and dividing the cavity into a gear section and an end section. A gear set is disposed within the gear section and including at least one gear rotatable about an axis. The plate is movable longitudinally along the axis for compressing the gear set. The vehicle also includes a reservoir fluidly connected to the outlet of the first fluid pump. The vehicle further includes a second fluid pump having an inlet fluidly connected to the reservoir for receiving fluid from the reservoir and an outlet fluidly connected to the internal combustion engine for supplying the lubricating fluid to the internal combustion engine.

Compressing the gear set helps improve overall efficiency of the associated fluid pump.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, a lubricating fluid system 100 for a vehicle 102 is shown and described herein.

In the exemplary embodiments shown and described herein, the vehicle 102 is implemented as an automobile (not separately numbered). However, it should be appreciated that the lubricating fluid system 100 described herein may be implemented in other vehicles 102, including, but not limited to, military vehicles, racecars, industrial equipment, trucks, motorcycles, aircraft, locomotives, and watercraft.

Furthermore, the lubricating fluid system 100 described herein may also be implemented in non-vehicle applications (not shown).

Figure 1:
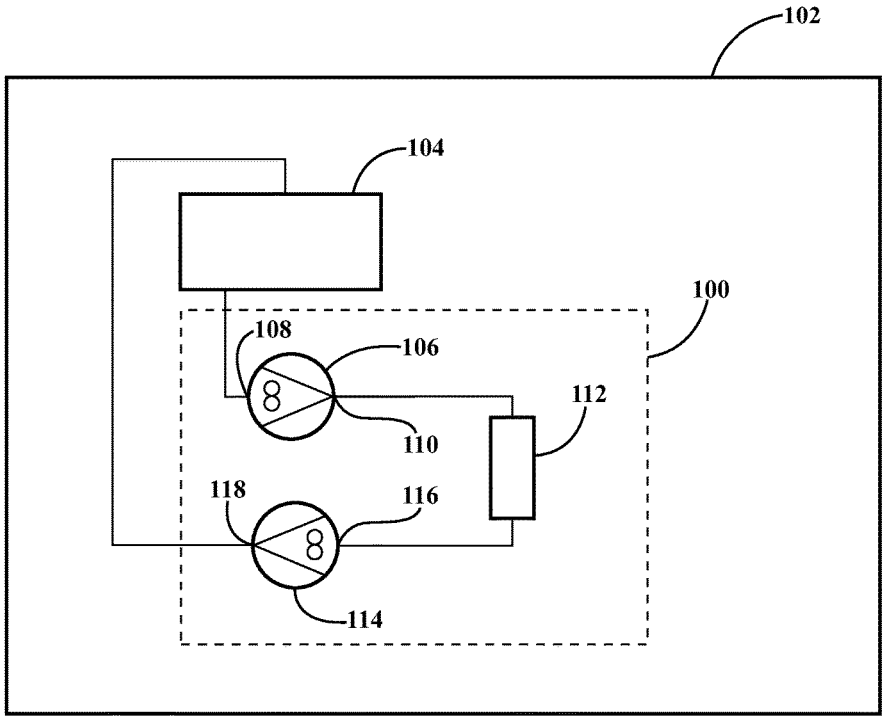
FIG. 1 is a schematic diagram of a lubricating fluid system of a vehicle according to one exemplary embodiment.

In one embodiment, as shown in FIG. 1, the vehicle 102 includes an internal combustion engine 104, hereafter referred to as an "engine". The engine 104 utilizes fluids, including lubricating oils, as is readily appreciated by those skilled in the art. It should also be appreciated that the lubricating fluid system 100 may be utilized with other types of engines (not shown) and non-engine applications (not shown).

The lubricating fluid system 100 includes a first fluid pump 106. In the exemplary embodiment shown in FIG. 1, the first fluid pump 106 includes an inlet 108 fluidly connected to the engine 104. The first fluid pump 106 may be alternatively referred to as a "scavenge oil pump" by those skilled in the art. However, no specific configuration or use of the first fluid pump 106 should be implied by this naming convention. It should be appreciated that the first fluid pump 106 may be utilized and/or otherwise implemented without the remainder of the lubricating fluid system 100. Furthermore, the first fluid pump 106 may be utilized to pump fluids other than lubricating oils.

The first fluid pump 106 includes an outlet 110 fluidly connected to a reservoir 112. The reservoir 112 receives fluid from the first fluid pump 106 for storage of fluid therein. The lubricating fluid system 100 further includes a second fluid pump 114 having an inlet 116 and an outlet 118. The inlet 116 is fluidly connected to the reservoir 112 and the outlet 118 is fluidly connected to the engine 104 to deliver fluid back to the engine 104.

Figure 2:
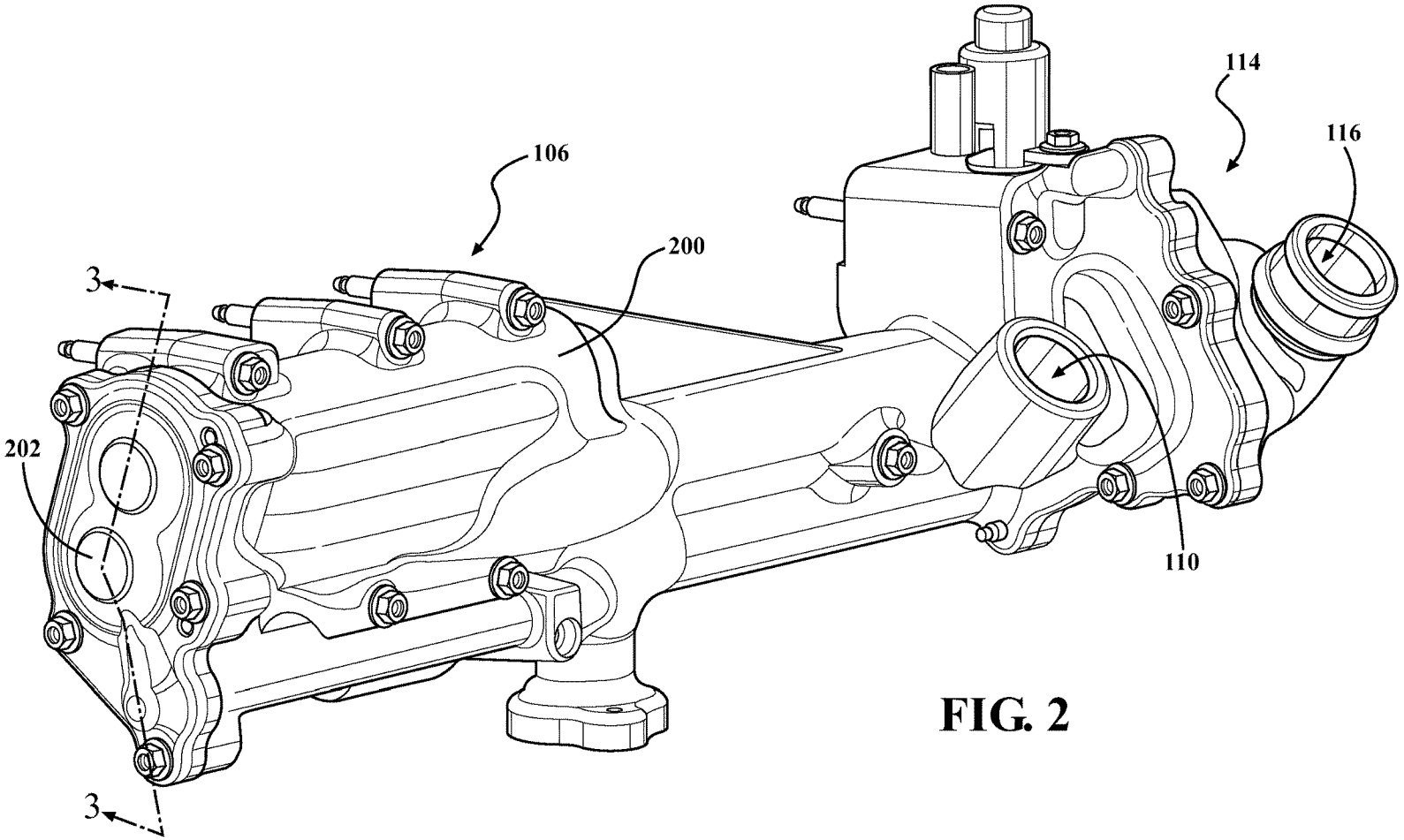
FIG. 2 is a perspective view of a first fluid pump and a second fluid pump of the lubricating fluid system according to one exemplary embodiment.

One exemplary embodiment of the first and second fluid pumps 106, 114 are shown in FIG. 2. The first fluid pump 106 includes a housing 200 including an end cap 202. In the exemplary embodiments, the housing 200 is formed primarily of a metal. However, it should be appreciated that other materials may be utilized to form the housing 200, as well as other parts of the first fluid pump 106. The housing 200 of the pump defines the inlet 108 and the outlet 110, which can be seen in FIG. 2. The housing 200 also defines a cavity 300, as shown in FIG. 3.

Figure 3:
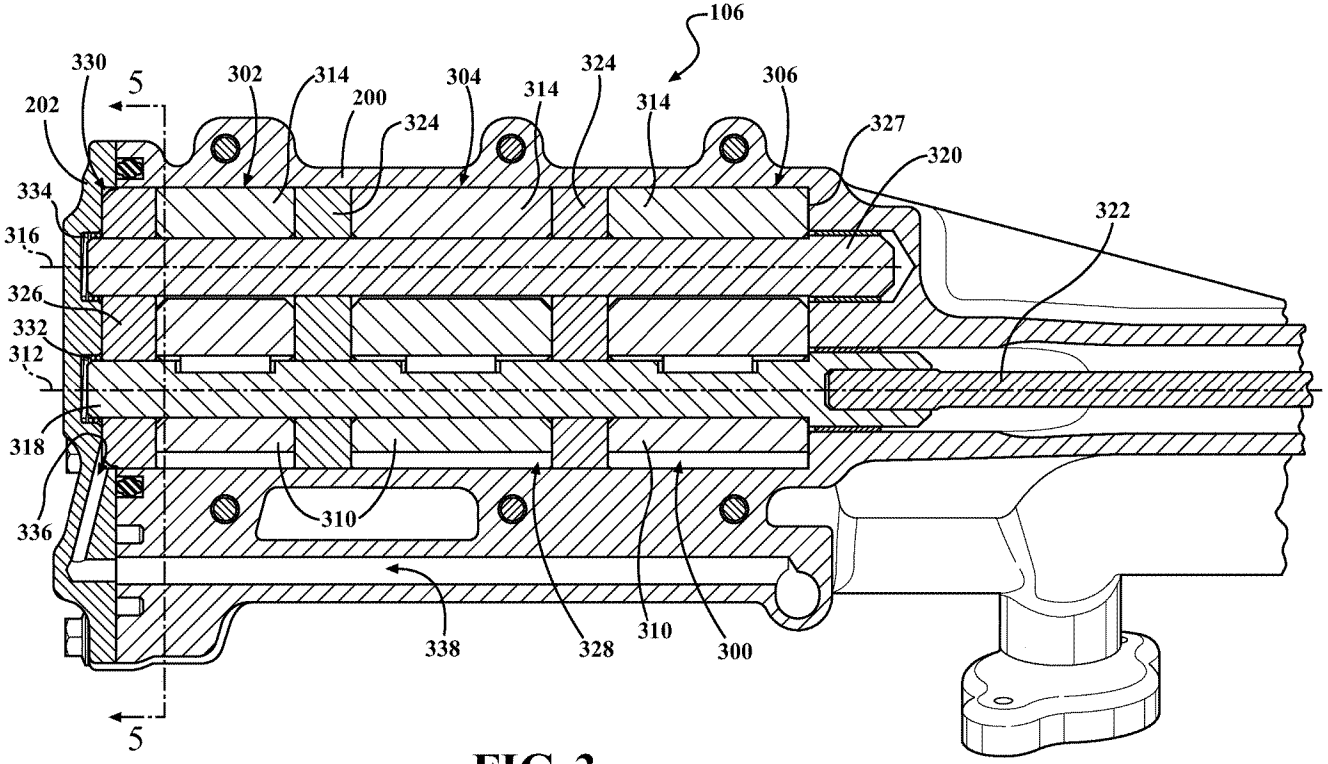
FIG. 3 is a partial cross-sectional view of the first fluid pump according to the line 3-3 in FIG. 2 and according to one exemplary embodiment.
Figure 4:
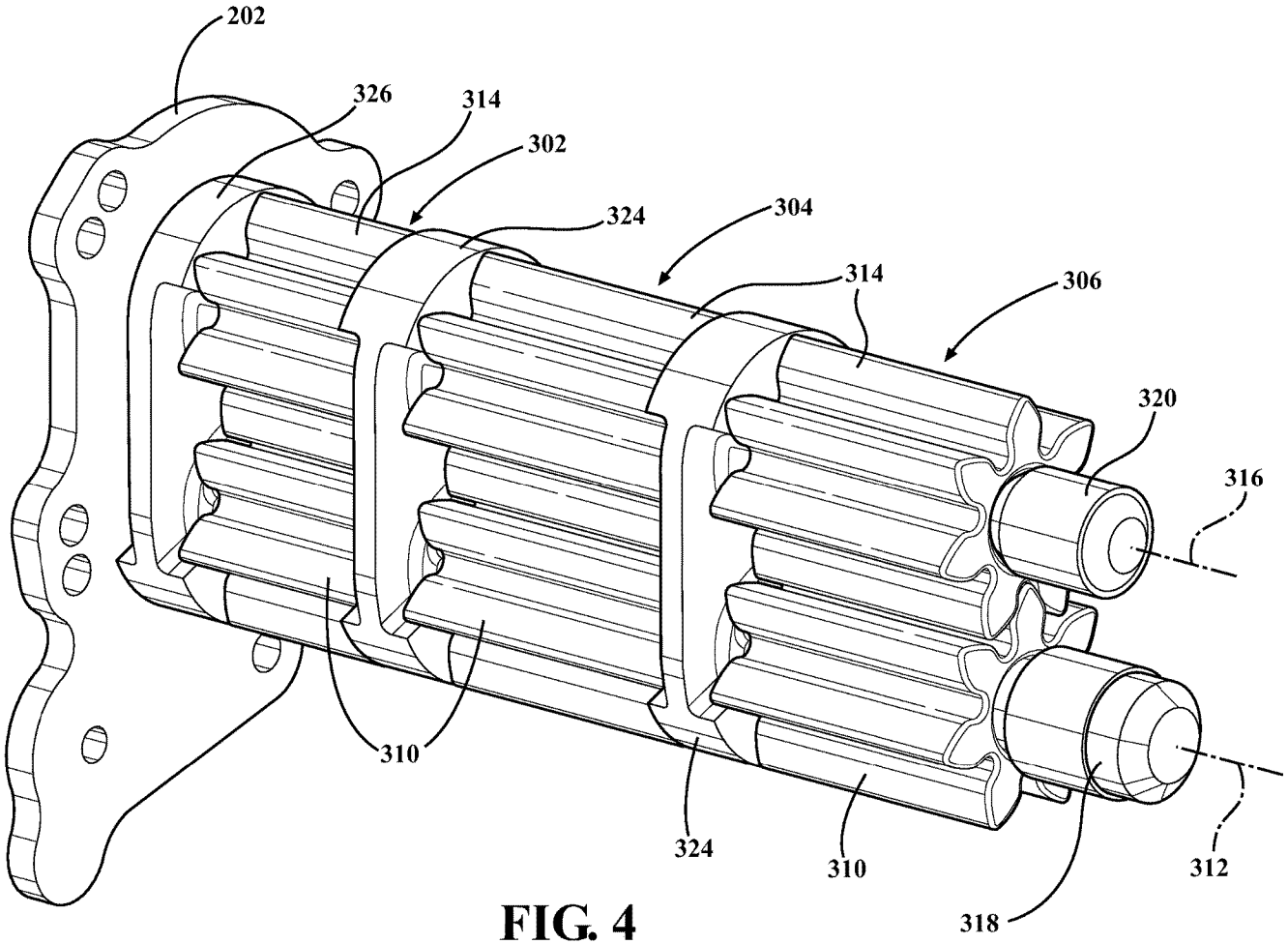
FIG. 4 is a perspective view of gear sets, separator plates, and an end plate of the first fluid pump according to one exemplary embodiment.

Referring now to FIGS. 3 and 4, the first fluid pump 106 includes at least one gear set 302, 304, 306 having at least one gear 310, 314 rotatable about an axis, 316. In the exemplary embodiments shown in FIGS. 3 and 4, the first fluid pump 106 includes a first gear set 302, a second gear set 304, and a third gear set 306. Each gear set includes a first gear 310 rotatable about a first axis 312 and a second gear 314 meshable with the first gear 310 and rotatable about a second axis 316. Due to the configuration of the gears 310, 314, the first fluid pump 106 may be referred to as an "external gear pump" by those skilled in the art. However, it should be appreciated that other types and/or configurations of gears and gear sets may be implemented by those skilled in the art.

The first fluid pump 106 of the exemplary embodiments also includes a first axle 318 coupled to the first gear 310 and rotatable about the first axis 312 and a second axle 320 coupled to the second gear 314 and rotatable about the second axis 316. More particularly, in the exemplary embodiments, the first axle 318 is coupled to each first gear 310 of each gear set 302, 304, 306 and the second axle 320 is coupled to each second gear 314 of each gear set 302, 304, 306. The first axle 318 is coupled to a powered shaft 322 for driving operation of the first fluid pump 106. The powered shaft 322 may be coupled to the engine 104 or any other source of movement as is appreciated by those skilled in the art.

The first fluid pump 106 includes at least one separator plate 324 separating two of the plurality of gear sets 302, 304, 306. In the exemplary embodiments shown in FIGS. 3 and 4, two separator plates 324 are utilized and disposed between the first gear set 302 and the second gear set 304 and the second gear set 304 and the third gear set 306. Of course, in other embodiments, any number of gear sets may be utilized as is appreciated by those skilled in the art.

Figure 5:
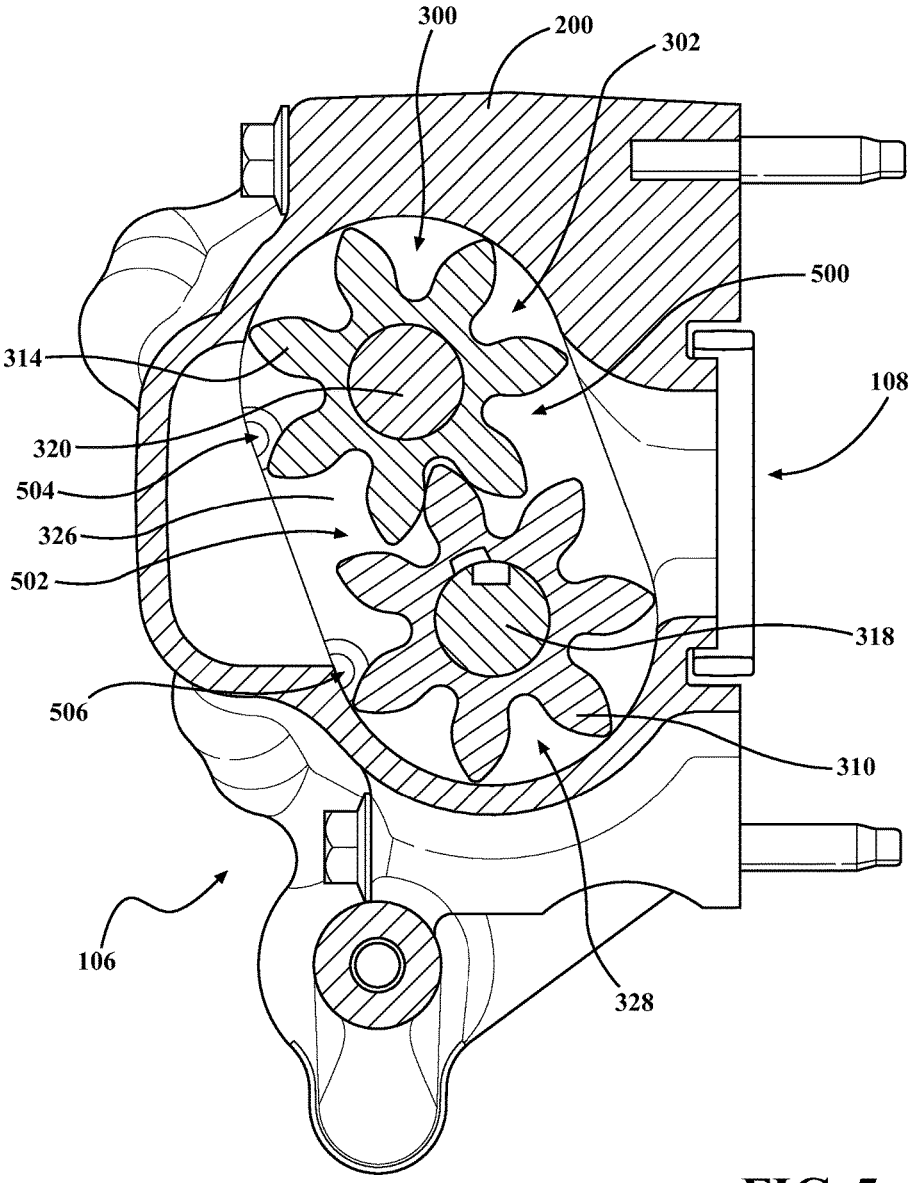
FIG. 5 is a partial cross-sectional view of the first fluid pump according to the line 5-5 in FIG. 3 and according to one exemplary embodiment.

Referring now to FIG. 5, the at least one gear set 302, 304, 306 divides the cavity 300 into a low pressure side 500 and a high pressure side 502. The low pressure side 500 is fluidly connected to the inlet 108 for receiving fluid, as is shown in FIG. 5. The high pressure side 502 is fluidly connected to the outlet 110. This connection is shown in FIGS. 1 and 2, but not explicitly shown in the FIG. 5.

Referring again to FIGS. 3 and 4, the first fluid pump 106 further includes an end plate 326. The end plate 326 is disposed within the cavity 300 and divides the cavity into a gear section 328 and an end section 330. The at least one gear set 302, 304, 306 is disposed in the gear section 328.

The end plate 326 is movable longitudinally along at least one of the axes 312, 316. Said another way, the end plate 326 may move in a direction that is parallel to at least one of the axes 312, 316. This movement allows the end plate 326 to compress the at least one gear set 302, 304, 306. In the exemplary embodiments, the end plate 326 compresses the gear sets 302, 304, 306 and the separator plates 324 together and against a proximal end 327 of the housing, opposite the end cap 202.

Figure 7:
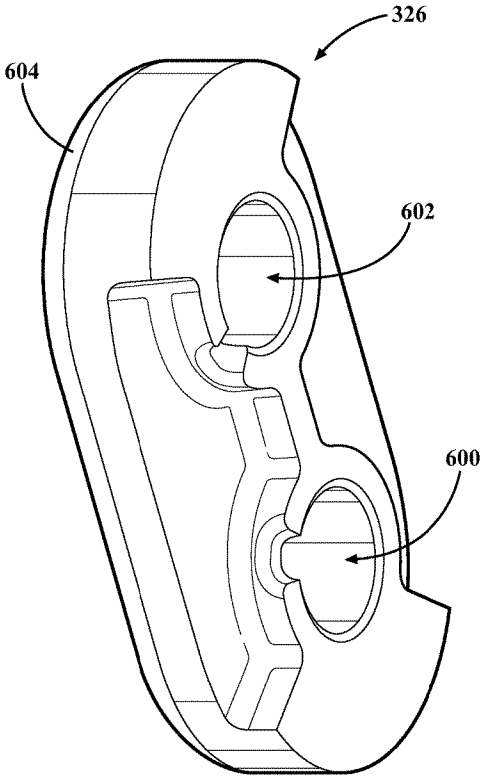
FIG. 7 is a perspective view of the end plate according to another exemplary embodiment.
Figure 6:
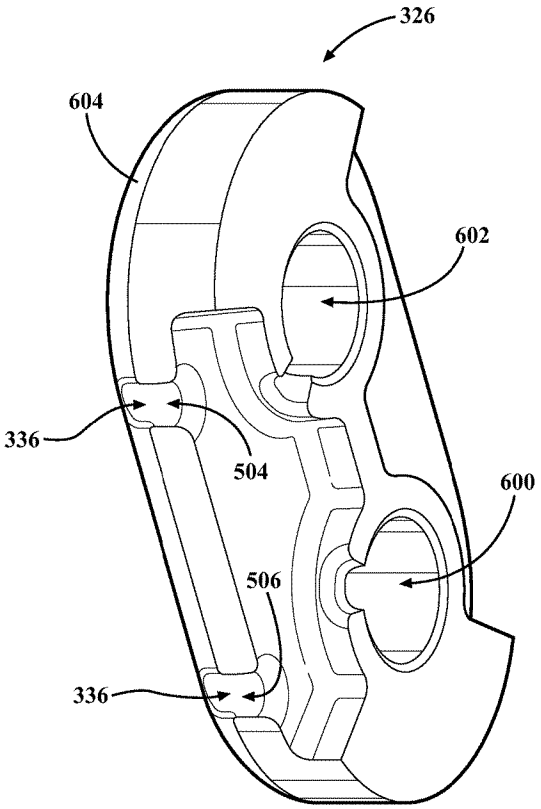
FIG. 6 is a perspective view of the end plate according to one exemplary embodiment.
Figure 8:
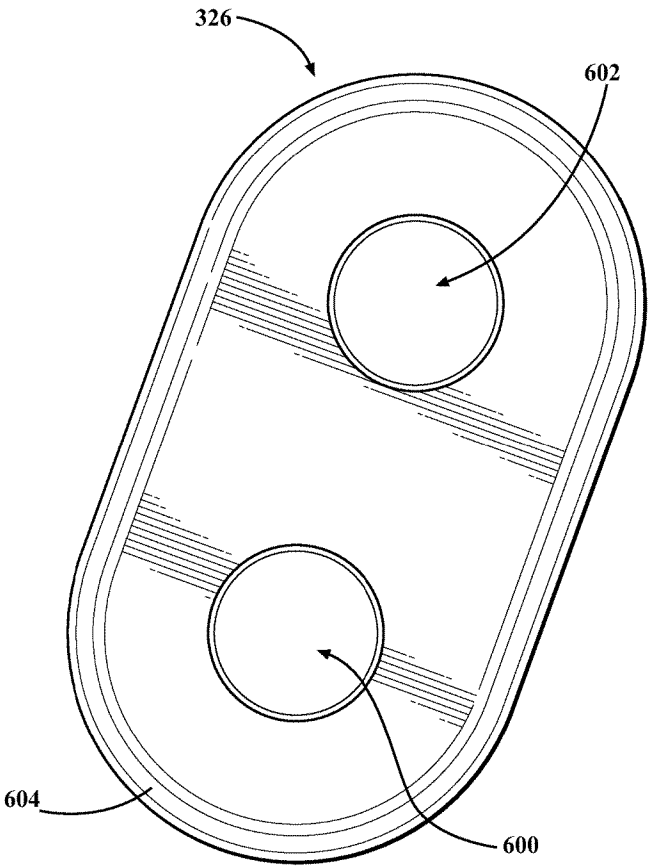
FIG. 8 is an end view of the end plate according to the exemplary embodiment of FIG. 7.

Referring now to FIGS. 6-8, the end plate 326 of the exemplary embodiments defines a first void 600 for accommodating the first axle 318 and a second void 602 for accommodating the second axle 320. The axles 318, 320, as assembled into the voids 600, 602 of the end plate 326, can be seen most clearly in FIG. 3.

Figure 9:
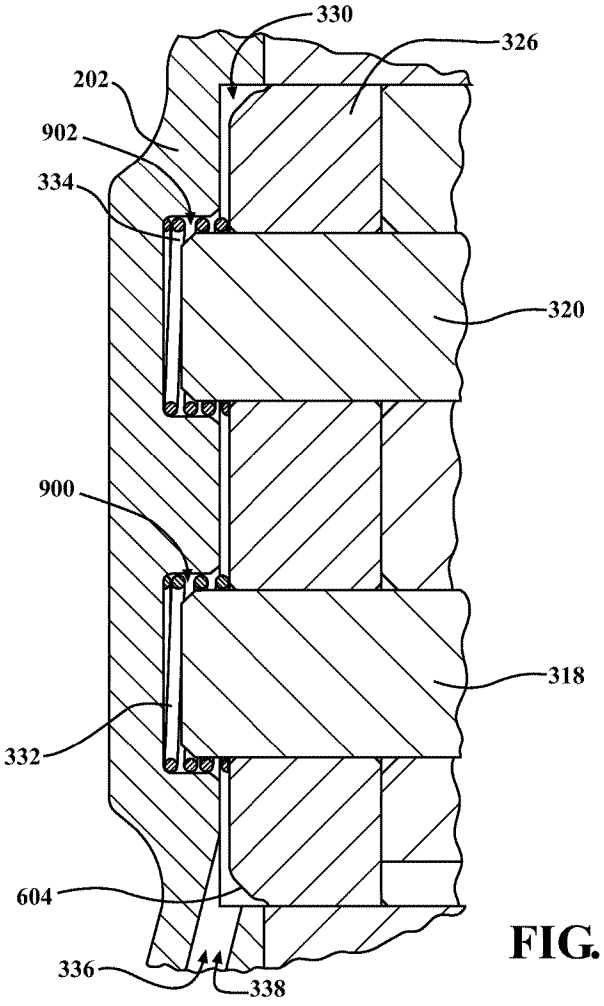
FIG. 9 is an enlargement of a portion of the cross-sectional view of FIG. 5 according to one exemplary embodiment.

Referring again to FIG. 3, the first fluid pump 106 of the exemplary embodiments further includes at least one spring 332, 334 engaging the end plate 326 and forcing the end plate 326 toward the at least one gear set 302, 304, 306. In the exemplary embodiments, as best seen in FIG. 9, a first spring 332 and a second spring 334 nest, respectively, in a first recess 900 and a second recess 902 formed by the end cap 202. The recesses 900, 902 may also accommodate the axles 318, 320, as shown in FIG. 9. In the exemplary embodiments, the first spring 332 is a coil disposed about the first axle 318 and the second spring 334 is a coil disposed about the second axle 320. However, those skilled in the art appreciate other techniques for implementing the at least one spring 332, 334.

Referring now to FIGS. 3, 5, 6, and 9, the first fluid pump 106 further includes at least one channel 336 in fluidic communication with the end section 330. The at least one channel 336 may supply a fluid to the end section 330. When pressurized, the fluid presses against the end plate 326 to force the end plate 326 toward the at least one gear set 302, 304, 306. By compressing the at least one gear set 302, 304, 306, efficiency of the first fluid pump 106 is improved.

In the exemplary embodiment shown in FIGS. 5 and 6, the at least one channel 336 is implemented with at least one hole 504, 506 disposed through the end plate 326 to fluidly connect the gear section 328 and the end section 330. More particularly, the at least one hole 504, 506 disposed through the plate 326 fluidly connects the high pressure side 502 of the gear section 328 with the end section 330. As such, high pressure fluid generated by the first fluid pump may be utilized to compress the gear sets 302, 304, 306 and separator plates 324 together. As can be seen in FIGS. 5 and 6, the at least one hole 504, 506 is implemented with a first hole 504 and a second hole 506. However, any number of holes 504, 506 may be utilized.

In the exemplary embodiment shown in FIGS. 3 and 9, the at least one channel 336 is implemented with a passage 338 in fluidic communication with the second fluid pump 114. More specifically, the passage 338 receives a pressurized fluid from the second fluid pump 114, which is then delivered to the end section 330 to compress the gear sets 302, 304, 306 and separator plates 324 together. As shown in FIG. 3, the passage 338 is defined by the housing 200 and the end cap 202. The passage 338 may be formed during a casting process of the housing 200 and the end cap 202. Alternatively, the passage 338 may be formed by machining the housing 200 and/or the end cap 202.

As shown best in FIGS. 6-9, the end plate 326 defines a chamfer 604 extending around a peripheral edge of the side of the end plate 326 facing the end section 330 of the cavity 300. The chamfer 604 acts to distribute the fluid around the end plate 326 and balance the forcing of the end plate 326 toward the at least one gear set 302, 304, 306. As shown in FIGS. 5-6, at least a portion of the chamfer 604 is adjacent the connection of the passage 338 to the end section 330. As such, the chamfer 604 is utilized to ease fluid to flow into the end section 330.

As has been stated above, the end plate 326 is movable and may be actuated with at least one spring 332, 334 and/or fluid in the end section 330 to compress the gear sets 302, 304, 306 and the separator plates 324 together. As such, the first fluid pump 106 may be assembled with the end plate 326 having generally consistent dimensions. Said another way, the end plate 326 need not be manufactured in a plurality of widths (not numbered) in order to accommodate manufacturing variances in the gear sets 302, 304, 306 and/or separator plates 324.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A fluid pump comprising:

a housing defining a cavity;

an end plate disposed within the cavity and dividing the cavity into a gear section and an end section;

a gear set disposed within the gear section and including a first gear rotatable about a first axis and a second gear meshable with the first gear and rotatable about a second axis;

a first spring disposed about the first axis and a second spring disposed about the second axis, wherein each of the first spring and the second spring engages the end plate and forces the end plate toward the gear set;

a first axle coupled to the first gear and rotatable about the first axis; and a second axle coupled to the second gear and rotatable about the second axis;

wherein the end plate is movable longitudinally along each of the first and second axis for compressing the gear set and defines a first recess for accommodating the first axle and a second recess for accommodating the second axle.

2. The fluid pump as set forth in claim 1 further comprising a channel in fluidic communication with the end section for supplying a fluid to the end section to force the plate toward the gear set.

3. The fluid pump as set forth in claim 2 wherein the channel is further defined as at least one hole disposed through the end plate to fluidly connect the gear section and the end section.

4. The fluid pump as set forth in claim 3 wherein the gear set divides the cavity into a low pressure side and a high pressure side and wherein the at least one hole disposed through the end plate is in fluidic connection with the high pressure side.

5. The fluid pump as set forth in claim 2 wherein the channel is further defined as a passage in fluidic communication with a second fluid pump.

6. The fluid pump as set forth in claim 1 wherein the gear set is further defined as a plurality of gear sets.

7. The fluid pump as set forth in claim 6 further comprising at least one separator plate separating two of the plurality of gear sets.

8. The fluid pump as set forth in claim 1, wherein the housing includes an end cap defining a first recess and a second recess, and wherein the first spring is disposed about the first axle and nests in the first recess and the second spring is disposed about the second axle and nests in the second recess.

9. The fluid pump as set forth in claim 8 wherein the first recess accommodates the first axle and the second recess accommodates the second axle.

10. A lubricating fluid system for a vehicle, comprising:

a first fluid pump, including:

a housing defining an inlet for receiving fluid, a cavity fluidly connected to the inlet, and an outlet fluidly connected to the cavity;

an end plate disposed within the cavity and dividing the cavity into a gear section and an end section;

a gear set disposed within the gear section and including a first gear rotatable about a first axis and a second gear meshable with the first gear and rotatable about a second axis;

a first spring disposed about the first axis, engaging the end plate, and forcing the end plate toward the gear set, and a second spring disposed about the second axis, engaging the end plate, and forcing the end plate toward the gear set, wherein the housing includes an end cap defining a first recess and a second recess, and wherein the first spring is disposed about the first axle and nests in the first recess and the second spring is disposed about the second axle and nests in the second recess;

a first axle coupled to the first gear and rotatable about the first axis; and a second axle coupled to the second gear and rotatable about the second axis;

wherein the end plate is movable longitudinally along each of the first and second axis for compressing the gear set and defines a first recess for accommodating the first axle and a second recess for accommodating the second axle;

a reservoir fluidly connected to the outlet of the first fluid pump; and a second fluid pump having an inlet fluidly connected to the reservoir for receiving fluid from the reservoir.

11. The system as set forth in claim 10 further comprising a channel in fluidic communication with the end section for supplying a fluid to the end section to force the end plate toward the gear set.

12. The system as set forth in claim 11 wherein the channel is further defined as a passage in fluidic communication with an outlet of the second fluid pump.

13. The system as set forth in claim 10 wherein the channel is further defined as at least one hole disposed through the end plate to fluidly connect the gear section and the end section.

14. The system as set forth in claim 13 wherein the gear set divides the cavity into a low pressure side and a high pressure side and wherein the at least one hole disposed through the end plate is in fluidic connection with the high pressure side.

15. The system as set forth in claim 10 wherein the first recess accommodates the first axle and the second recess accommodates the second axle.

16. A vehicle comprising:

an internal combustion engine;

a first fluid pump including:

a housing defining an inlet fluidly connected to the internal combustion engine for receiving a lubricating fluid, a cavity fluidly connected to the inlet, and an outlet fluidly connected to the cavity;

an end plate disposed within the cavity and dividing the cavity into a gear section and an end section;

a gear set disposed within the gear section and including a first gear rotatable about a first axis and a second gear meshable with the first gear and rotatable about a second axis;

a first spring disposed about the first axis and a second spring disposed about the second axis, wherein each of the first spring and the second spring engages the end plate and forces the end plate toward the gear set;

a first axle coupled to the first gear and rotatable about the first axis; and a second axle coupled to the second gear and rotatable about the second axis;

wherein the end plate is movable longitudinally along each of the first and second axis for compressing the gear set and defines a first recess for accommodating the first axle and a second recess for accommodating the second axle;

a reservoir fluidly connected to the outlet of the first fluid pump; and a second fluid pump having an inlet fluidly connected to the reservoir for receiving fluid from the reservoir and an outlet fluidly connected to the internal combustion engine for supplying the lubricating fluid to the internal combustion engine.

17. The vehicle as set forth in claim 16 further comprising a channel in fluidic communication with the end section for supplying the lubricating fluid to the end section to force the end plate toward the gear set.

* * * * *